United States Patent [19]

Lauro

[11] Patent Number: 4,611,431

[45] Date of Patent: Sep. 16, 1986

[54] PASSAGEWAY CLOSURE OF ADJUSTABLE WIDTH

[75] Inventor: Charles W. Lauro, Akron, Ohio

[73] Assignee: Gerber Products Company, Fremont, Mich.

[21] Appl. No.: 786,409

[22] Filed: Oct. 10, 1985

[51] Int. Cl.[4] ..... E06B 3/68

[52] U.S. Cl. ..... 49/55; 49/57

[58] Field of Search ..... 49/50, 55, 56, 57

[56] References Cited

U.S. PATENT DOCUMENTS 4,038,800 8/1977 Daley, Jr. ..... 49/55 X 4,465,262 8/1984 Itri et al. ..... 49/55 X

FOREIGN PATENT DOCUMENTS 2041051 9/1980 United Kingdom ..... 49/55

*Primary Examiner*—Kenneth Downey

*Attorney, Agent, or Firm*—Townsend and Townsend

[57] ABSTRACT

A gate or similar closure suitable for temporary and quick installation across a passageway is comprised of a pair of vertical posts, a vertical barrier extending laterally from one of the posts, and a gate whose pivoting edge is capable of being secured to the barrier at any location along its width, and whose other edge is capable of being latched to the other post. By selecting the point at which the hinge is secured along the width of the barrier, one may adjust the closure to span a range of passageways of varying width.

10 Claims, 5 Drawing Figures

PASSAGEWAY CLOSURE OF ADJUSTABLE WIDTH

BACKGROUND OF THE INVENTION

This invention relates to gates, doors and similar structures and the frames to which they are mounted. In particular, this invention relates to safety barriers for easy temporary installation across an opening such as a doorway or stairway, such barriers being the type generally used to prevent the passage of small children or animals.

Safety barriers are widely used as temporary installations in homes where infants or animals are present, to prevent the infants or animals from entering a stairwell, leaving or entering a room, or similar types of access or activity. Such barriers are typically designed to be quickly installed and removed so that the restricted area can be readily shifted from one location to another and the barrier can be readily removed when the child or animal is not present.

The typical home will have a number of passageways where such barriers will be useful. These may include, for example, hallways, doorframes, and stairwell entrances. The widths of these passageways may vary considerably from one to the next. In addition to spanning the width of the passageway, such barriers generally include a gate which is openable only by an adult to permit passage when the barrier is in place.

It is an object of this invention to provide a barrier which is readily adjustable for installation across passageways of various widths, providing a gate for adult passage, and yet providing full lateral blockage of the passageway when the gate is closed.

SUMMARY OF THE INVENTION

A novel closure is provided herein consisting of a pair of vertical posts, a vertical barrier extending laterally from one of the posts, and a gate whose pivoting edge is capable of being secured to the barrier at any location along its width, and whose other edge is capable of being latched to the other post. The width of the barrier defines the range of variation of width of the passageway across which the closure may be installed.

DETAILED DESCRIPTION OF THE INVENTION AND PREFERRED EMBODIMENTS

Figure 1A:
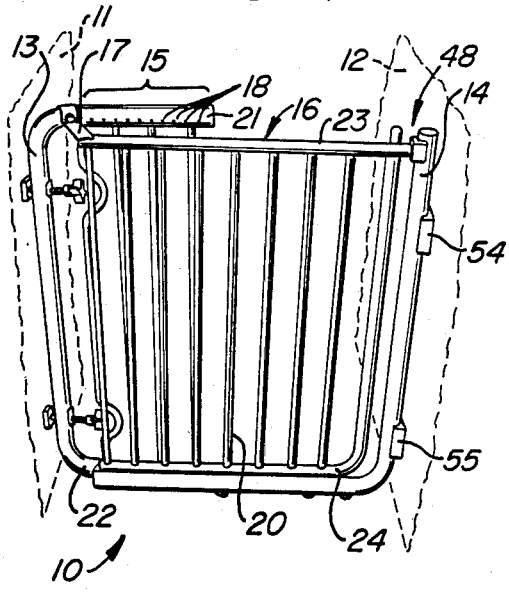
FIG. 1A is an illustration of one embodiment of the present invention, shown in front elevation with the gate closed.
Figure 1B:
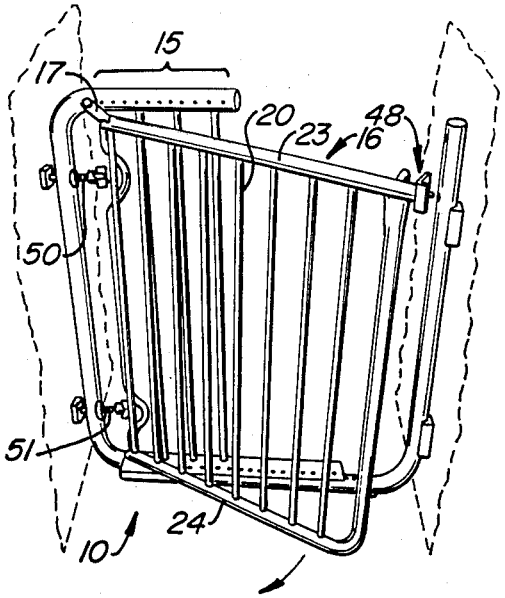
FIG. 1B is a front elevation view of the embodiment of FIG. 1A with the gate open.

In FIGS. 1A and 1B, a closure 10 in accordance with the present invention is shown installed in a passageway between a pair of opposing walls 11 and 12. The closure is supported by two posts 13, 14. Extending outward from one post 13 is a vertical barrier 15. This barrier extends part way into the passageway to narrow the width of the passage. The remainder of the passage width is closed by a gate 16. The gate 16 is attached to the barrier 15 by a hinge 17 which can be secured to the barrier at any of a plurality of points 18 along the width of the barrier. The overall width of the closure may thus be adjusted to accommodate a range of passage widths, the narrowest being achieved when the position of the hinge 17 is closest to the post 13, and the widest being when the hinge is in the location furthest outward from the post 13.

In preferred embodiments of the invention, both the barrier and gate are comprised of vertical rails 20, spaced apart at regular intervals, yet sufficiently close together to prevent passage by the infant or animal sought to be restrained. The rails on the barrier 15 are fastened into upper and lower horizontal arms 21, 22 extending from the post 13. The rails on the gate 16 are likewise fastened to upper and lower rails 23, 24.

Figure 2:
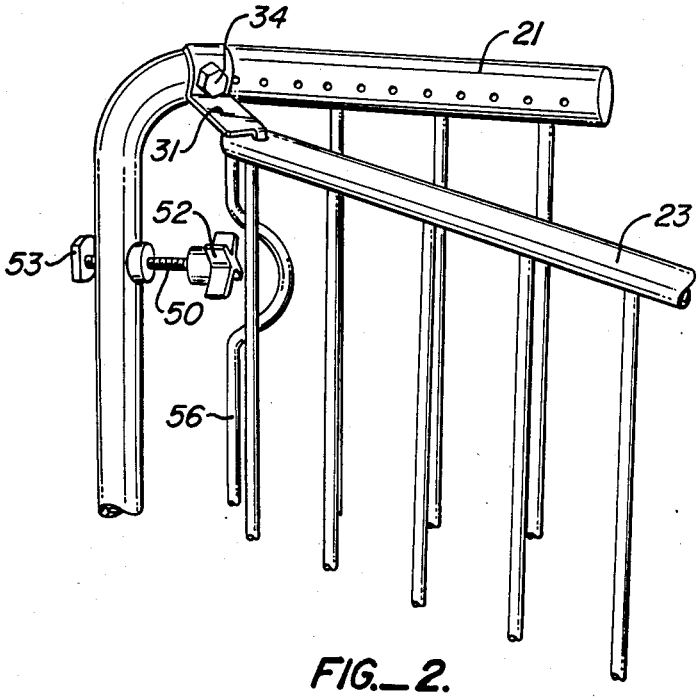
FIG. 2 is an enlarged view of an upper left corner segment of the embodiment of FIGS. 1A and 1B.
Figure 3:
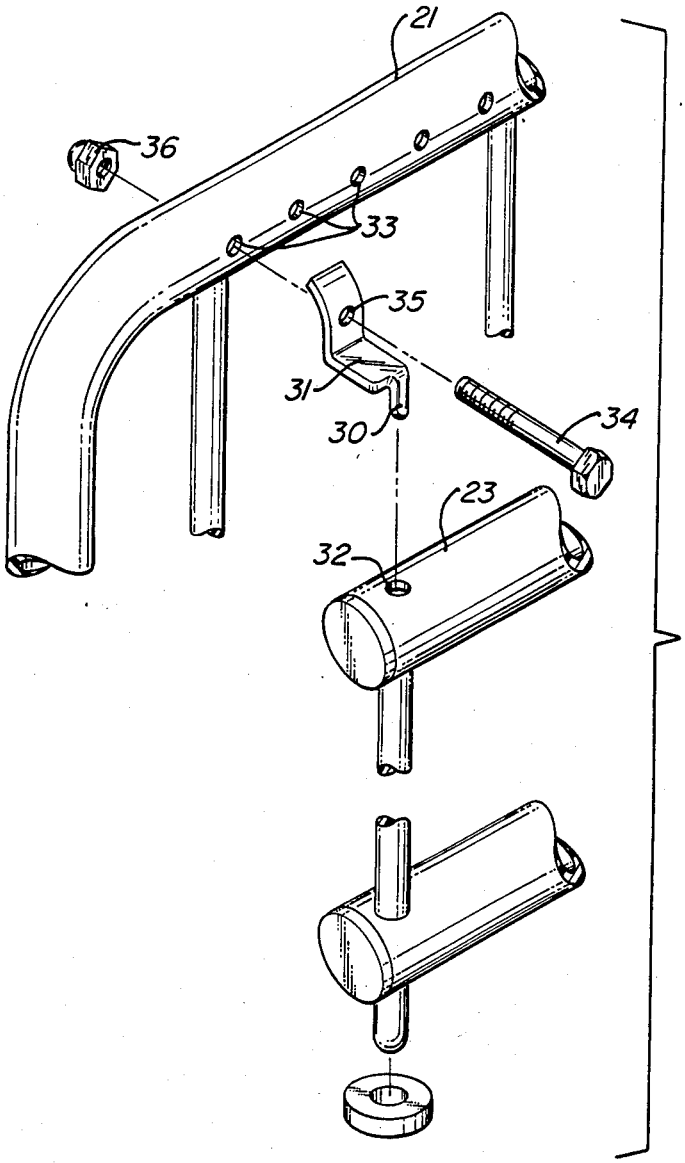
FIG. 3 is an exploded perspective view of an upper left corner segment of the embodiment of FIGS. 1A and 1B.

An enlarged view of the hinge 17 and its means of attachment to the barrier 15 is found in FIGS. 2 and 3. The hinge shown in these figures consists of a pin 30 extending downward from one end of a bracket 31, the pin 30 sized to fit inside a hole 32 in the upper rail 23 of the gate in pivotal manner to permit the gate to swing open and closed. The various points along the barrier where the bracket may be secured are defined by a series of horizontal holes 33 passing through the upper arm 21 of the barrier. Fastening is achieved by a bolt 34 inserted through a hole 35 of the bracket and a selected hole 33 along the barrier rail to correspond to the desired position of the gate. A nut 36 secures the bolt 34 in position.

Figure 4:
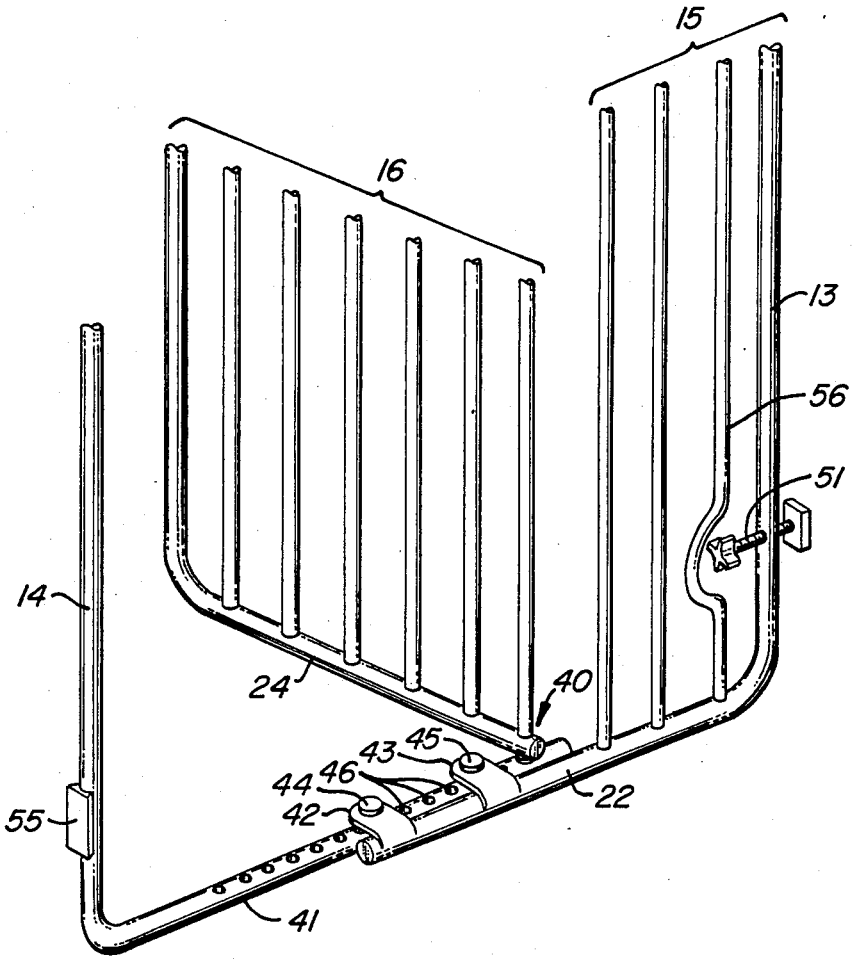
FIG. 4 is a perspective view of a lower segment of the embodiment of FIGS. 1A and 1B, viewed from the rear with the gate open.

The structure of the lower ends of the barrier and gate are shown in FIG. 4. The lower end of the gate 16 is secured through a pivot connection 40 to a horizontal arm 41 extending from the base of the second post 14 (the first post 13 being that from which the vertical barrier 15 extends). This pivot connection may be of any conventional construction, and may be as simple as a vertical pin extending either upward from the arm 41 or downward from the lower rail 24 of the gate, to mate with a corresponding hole in either the lower rail 24 or arm 41 as appropriate, to provide free rotation in the horizontal plane.

The width of the closure is established by the lower arms 41 and 22 extending outward from the posts 14 and 13, respectively. These arms are joined together in FIG. 4 to fix their combined length and thereby span the width of the passage in which the closure is to be installed. Securement is achieved by a pair of tabs 42 and 43 extending sideways from one arm to pass over the top of the other as shown. A pair of bolts 44, 45, one passing through each tab, mate with holes 46 in the other arm for secure fastening. An excess of holes 46 is provided, extending along the length of the second arm, to permit securement of the bolts at any of a number of positions along its length. Thus, the combined length of the two arms 22, 41 may be selected or adjusted by insertion of the bolts into the appropriate holes, and a range of widths is accordingly provided. At smaller widths, the rails of the gate 16 and those of the barrier 15 overlap when the gate is closed. At the greatest width, on the other hand, there is no overlap and the rails of both the gate and the barrier form a continuous arrangement of regularly spaced rails. A latch 48

(FIGS. 1A and 1B) is positioned at the upper end of the exposed edge of the gate.

In the preferred constructions as shown, the gate 16 and vertical barrier 15 are of approximately the same height so as to form a continuous barrier when the gate is closed. Furthermore, in most applications, the vertical barrier 15 will be of substantially lesser width than the gate 16. In general, however, any combination of dimensions may be used.

The closure is rigidly secured in the passageway by conventional means. A particularly convenient construction is shown in the drawings. A pair of clamp screws 50, 51 pass laterally through one of the two posts 13, 14 extending in the direction of the passageway wall. Each screw has a knob 52 shaped for easy hand turning. A pressure pad 53 is loosely attached to the other end of each clamp screw for compression against the wall. Gripping pads 54, 55 are secured to the opposite post to prevent lateral slippage along the wall surface. The closure is thus installed in a passageway by first selecting an appropriate spacing of the two base arms 22, 41 of the structure to fill almost the entire width of the passage, securing these arms together by inserting and tightening the bolts 44, 45, placing the assembled closure in the passage, and turning the clamp screws 50, 51 by their respective knobs to firmly compress the pressure pads 53 and gripping pads 54, 55 against the walls.

When the barrier 15 is comprised of vertical rails, as shown in the drawings, the rail 56 closest to the wall may be shaped as shown to provide clearance for the clamp screw knobs, permitting the clamp screws a wide degree of freedom in the lateral direction and adding to the variability of passage width in which the closure may be used.

The foregoing description is offered for illustrative purposes only. Numerous modifications and variations will be readily apparent to those skilled in the art, while still falling within the spirit and scope of the invention as claimed hereinbelow.

What is claimed is:

1. A closure of adjustable width for mounting across a passageway, said closure comprising:

first and second posts;

a vertical barrier extending laterally from said first post;

a gate having a hinge on a first vertical edge and a latch on a second vertical edge adapted for engagement with said second post; and means for securing said hinge to said vertical barrier at any of a plurality of positions along the width of said vertical barrier.

2. A closure in accordance with claim 1 in which said hinge securing means is comprised of a screw extending from said hinge and a hole at each of said positions to receive said screw.

3. A closure in accordance with claim 1 in which said hinge is positioned at the upper end of said first vertical edge and is comprised of a vertical pin and a hole capable of rotatably retaining said pin.

4. A closure in accordance with claim 1 further comprising first and second arms extending horizontally from the lower ends of said first and second posts, respectively, and adapted to be secured together in parallel relation at any of a plurality of positions along the lengths thereof.

5. A closure in accordance with claim 4 in which the lower end of said first vertical edge of said gate is pivotally secured to the end of said second arm.

6. A closure in accordance with claim 4 further comprising a third arm extending horizontally from the upper end of said first post, and in which said vertical carrier is comprised of a plurality of vertical rails spanning the distance between said first arm and said third arm, and said hinge securing means is comprised of a screw extending from said hinge and a plurality of holes positioned at intervals along said third arm to receive said screw.

7. A closure in accordance with claim 4 further comprising a pair of clamp screws extending laterally from one of said first and second posts to securely lodge said closure in said passageway.

8. A closure of adjustable width for mounting across a passageway, said closure comprising:

a first post having upper and lower arms extending horizontally therefrom and a plurality of vertical rails spanning the distance between said upper and lower arms to form a barrier to passage therethrough;

a second post having an arm extending from the lower end thereof, said arm being adapted to be secured against said lower arm of said first post in parallel relation at any of a plurality of positions along the length thereof;

a gate adapted for pivotal attachment at the lower end of a first vertical edge thereof to said arm of said second post, the top edge of said gate having a hole in vertical alignment with said pivotal attachment;

a bracket adapted to be secured to said upper arm of said first post at any of a plurality of positions along the length thereof; and a pin extending vertically from said bracket to rotatably mate with said hole.

9. A closure in accordance with claim 1 in which said gate and said vertical barrier are of approximately the same height.

10. A closure in accordance with claim 1 in which said vertical barrier is of substantially lesser width than said gate.

* * * * *